US011524308B2

(12) United States Patent
Whalley et al.

(10) Patent No.: US 11,524,308 B2
(45) Date of Patent: Dec. 13, 2022

(54) HANDHELD SPRAY DEVICE

(71) Applicant: Wats & Co Pty Ltd, Bellamack (AU)

(72) Inventors: Jessica Whalley, Bellamack (AU); Samantha Hair, Bellamack (AU)

(73) Assignee: WATS & CO PTY LTD, Bellamack (AU)

( * ) Notice: Subject to any disclaimer, the term of this patent is extended or adjusted under 35 U.S.C. 154(b) by 245 days.

(21) Appl. No.: 17/016,960

(22) Filed: Sep. 10, 2020

(65) Prior Publication Data

US 2022/0072572 A1 Mar. 10, 2022

(51) Int. Cl.

| | |
|---|---|
| ***B05B 11/00*** | (2006.01) |
| ***B05B 11/04*** | (2006.01) |
| ***A47K 7/08*** | (2006.01) |
| ***B08B 13/00*** | (2006.01) |
| ***B08B 3/02*** | (2006.01) |

(52) U.S. Cl.

CPC ..... *B05B 11/048* (2013.01); *A47K 7/08* (2013.01); *B05B 11/047* (2013.01); *B08B 3/026* (2013.01); *B08B 13/00* (2013.01)

(58) Field of Classification Search

CPC . B05B 11/048; B05B 11/047; B05B 11/0032; B05B 11/0037; B05B 11/043; B05B 11/3011; B05B 11/3057; A47K 7/08; B08B 3/026; B08B 13/00

See application file for complete search history.

(56) References Cited

U.S. PATENT DOCUMENTS

| | | | | |
|---|---|---|---|---|
| 4,098,434 | A * | 7/1978 | Uhlig | B65D 83/0055 222/105 |
| 5,114,255 | A * | 5/1992 | Villarreal | A46B 11/0013 401/206 |
| 6,210,064 | B1 * | 4/2001 | White | A46B 11/0062 401/279 |
| 6,394,316 | B1 * | 5/2002 | Daansen | F16K 15/044 222/207 |
| 8,152,400 | B2 * | 4/2012 | LaFlamme | A47L 13/17 401/187 |
| 8,167,510 | B2 * | 5/2012 | LaFlamme | A47L 13/26 401/206 |
| 8,517,623 | B2 * | 8/2013 | Cavaiani | A46B 9/005 401/186 |
| 9,918,593 | B2 * | 3/2018 | LeBlanc | A47K 7/03 |
| 2005/0199651 | A1 * | 9/2005 | Laflamme | B05B 11/3032 222/107 |
| 2006/0133886 | A1 * | 6/2006 | Willinger | A46B 11/0062 401/270 |

* cited by examiner

*Primary Examiner* — Vishal Pancholi

(74) *Attorney, Agent, or Firm* — Innovation Capital Law Group, LLP; Vic Lin

(57) ABSTRACT

A handheld spray device has a flexible bellow coupled to a base to thereby retain liquid therein. The bellow has a bulbous section adjacent the base, narrows away from the base to terminal section opposite the base and has a side notch formed at one side of the bellow between the bulbous section and the terminal section. The base also has a nozzle therethrough such that when the bellow is squeezed in use, the liquid is forced via the nozzle.

20 Claims, 4 Drawing Sheets

HANDHELD SPRAY DEVICE

FIELD OF THE INVENTION

This invention relates generally to a handheld spray device for baby care.

BACKGROUND OF THE INVENTION

Care of babies entails frequent diaper changing in combination with wet wipes for cleaning. It would be desirous however to eliminate or reduce the need for such wet wipes.

It is to be understood that, if any prior art information is referred to herein, such reference does not constitute an admission that the information forms part of the common general knowledge in the art, in Australia or any other country.

SUMMARY OF THE DISCLOSURE

There is provided herein a handheld spray device conveniently ergonomic and portable for directing a spray of water to clean a baby's bottom, thereby eliminating or reducing the requirement for wet wipes.

The device comprises a flexible bellow such as of silicon which may engage a base, typically rigid and of plastic such of ABS so as to retain liquid such as water therein. The base defines a nozzle therethrough such that squeezing of the bellow pressurises the contents therein, forcing liquid via the nozzle as a direct a spray for cleaning the baby's bottom.

The base may comprise a planar undersurface, thereby allowing for the standing upright of the device, readily available for picking up by the bellow.

In a preferred embodiment, the bellow comprises a bulbous section towards the base which narrows towards a terminal section away from the base. Furthermore, the bellow further preferably comprises a notch within a side of the bellow between the bulbous section and the terminal section thereby shaping the bellow ergonomically for convenient pickup, gripping and squeezing. For example, in one embodiment, the thumb may locate within the notch so as to squeeze the bellow between the thumb and the opposing forefingers. Alternatively, the forefingers may be engaged within the notch, with the thumb pressing oppositely over the terminal section.

In embodiments, the device comprises a series of valves and delivery tubes, pump mechanisms and air outlets for various modes of operation and for controlling the spray of liquid emanating from the device.

Furthermore, the device may comprise an exterior air outlet orientated to intersect the path of the nozzle, thereby providing disrupted flow or misting effect.

The device may comprise delivery tubes to separately source air or liquid contents from an interior of the bellow. The delivery tubes may comprise an arrangement of valves for controlling the flow and direction of air and water.

In embodiments the device may comprise an interior pump having a lever acting against a fulcrum to depress a plunger to force liquid contents via the nozzle. The lever may locate adjacent the notch and may comprise a counter brace acting against an opposite interior surface of the bellow such that the pump may be activated by squeezing the bellow at the notch opposing the forefingers pressing against an opposite side of the bellow.

The device may further comprise a lid which may rotatably engaged and outer section of the base. The lid may be rotated to lock the nozzle, thereby preventing leakage and/or dropping when the device is not in use. Specifically, the lid may comprise an aperture and a stopper which selectively collocate adjacent an undersurface protrusion of the outer section having the nozzle therein to either allow the novel to inject liquid via the aperture or be blocked by the stopper.

Other aspects of the invention are also disclosed.

BRIEF DESCRIPTION OF THE DRAWINGS

Notwithstanding any other forms which may fall within the scope of the present invention, preferred embodiments of the disclosure will now be described, by way of example only, with reference to the accompanying drawings in which.

DESCRIPTION OF EMBODIMENTS

Figure 1:
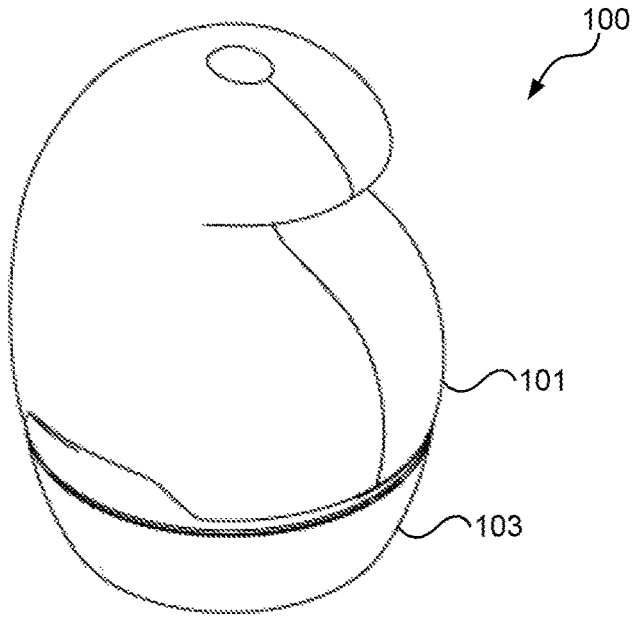
FIG. 1 shows a top perspective view of a handheld spray device in accordance with an embodiment.

FIG. 1 shows a handheld spray device comprising a flexible bellow 101 coupled to a base 103 so as to retain liquid such as water therein. The base 103 preferably has a circular cross-section and may comprise a planar undersurface for standing upright on a surface.

The bellow 101 may be made from a flexibly watertight material such as silicon or other soft plastics or urethane-based resins. The base 103 is preferably rigid such is made of ABS or other suitable hard plastic.

Figure 2:
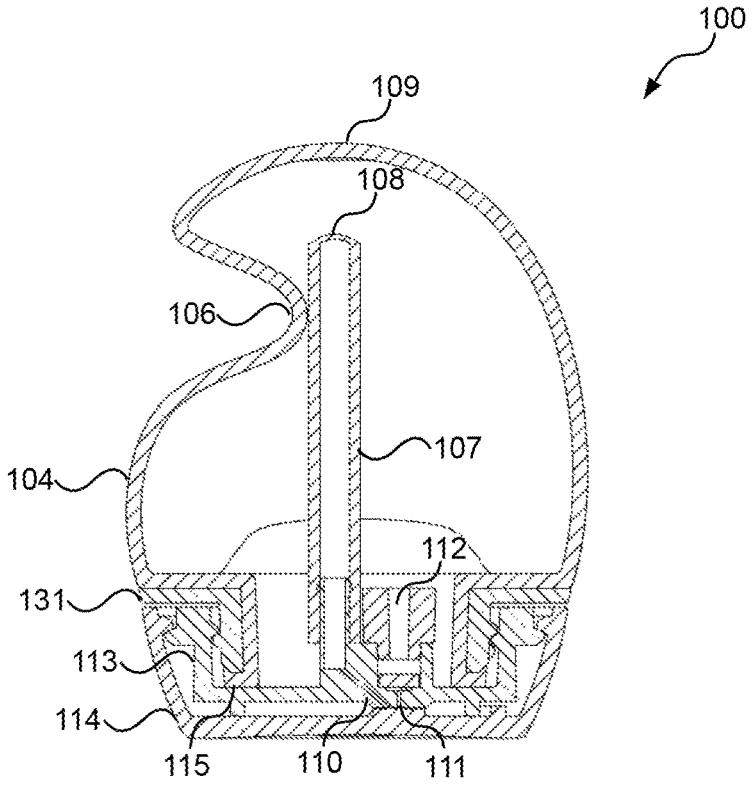
FIG. 2 shows a side elevation cross-sectional view of the device in accordance with an embodiment.

With reference to FIG. 2, the bellow 101 may comprise a bulbous section 104 adjacent the base 103 narrowing away from the base 103 to a terminal section 109 opposite the base 103. The bellow 101 may define a side notch 106 at one side of the bellow 101 between the bulbous section 104 and the terminal section 109.

The base 103 may comprise an outer section 113 which engages an inner section 131 to clamp a rim 115 of the bellow 101 therebetween. The outer section 113 may be unscrewed from the inner section 113 to refill the bellow 101.

The base 103 may further comprise a lid 114 which may rotatably coaxially engage the outer section 113 in the manner described in further detail below.

In embodiments shown in FIG. 2, the base 103 may have a liquid inlet 112 adjacent the base 103 and an air inlet 108 away from the base. The air inlet 108 may be formed at a distal end of a delivery tube 107. As such, when held in the orientation shown in FIG. 2, the liquid contents therein submerges the liquid inlet 112 while leaving the air inlet 108 exposed to air therein.

The liquid inlet 112 leads to a nozzle 111. As such, when the bellow 101 is squeezed and the contents therein pressurised, liquid is forced via liquid inlet 112 out from the nozzle 111 at high velocity.

Simultaneously, air is forced via the air inlet 108, down the delivery tube 108 and via an exterior air outlet 110. As can be seen in FIG. 10, the exterior air outlet 110 may be directed to intersect the path of the nozzle 111 so as to disrupt the laminar flow of liquid therefrom thereby creating a disrupted flow or misting effect.

Figure 3:
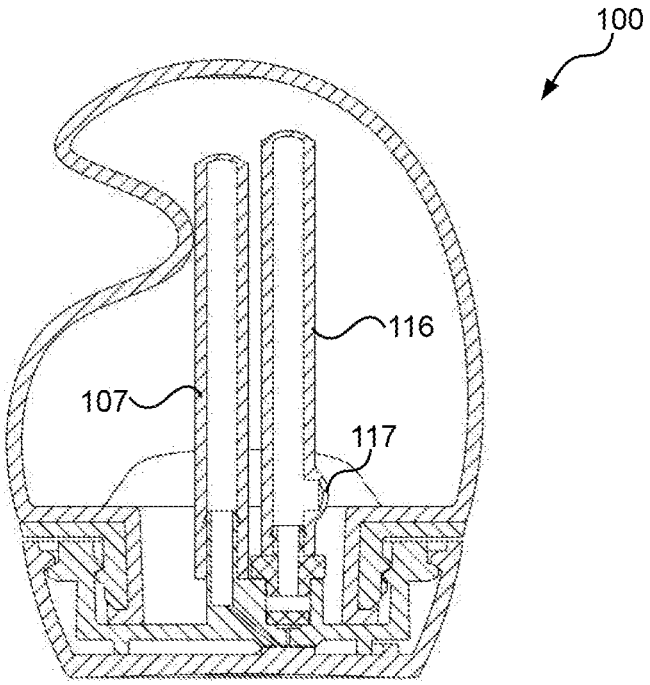
FIG. 3 shows a side elevation cross-sectional view of the device in accordance with an embodiment.

FIG. 3 shows a variation of the embodiment of FIG. 2 wherein the device 100 comprises a further delivery tube 116 interfacing the liquid inlet 112. The further delivery tube 116 may comprise a liquid inlet 117 towards the base 103 which is similarly submerged within liquid contents when the device 100 is held in the orientation of FIG. 3.

Figure 4:
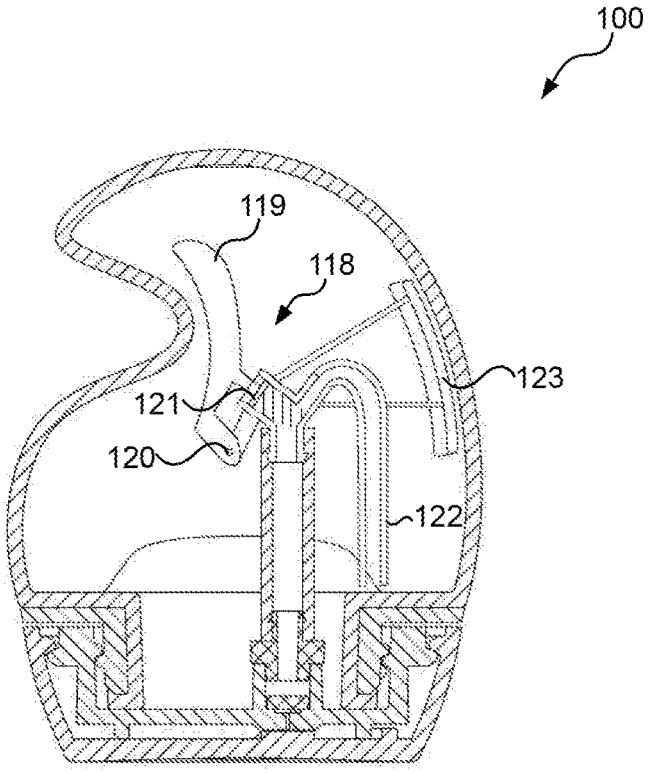
FIG. 4 shows a side elevation cross-sectional view of the device in accordance with an embodiment.

FIG. 4 shows an alternative embodiment wherein the device 100 comprises a pump 118 comprising a lever 119 acting against a fulcrum 120 to force a plunger 121 into a chamber to pressurise liquid contents therein which in turn flows via the nozzle 111.

In embodiments shown, the lever 119 locates adjacent the notch 106 such that depressing the bellow 101 at the notch thereby depresses the lever 119. The lever 119 may comprise a return mechanism such as a coil spring, compression spring or the like returning the lever 119 against the notch 106.

The pump 118 may comprise a liquid inlet tube 122.

The pump 118 may comprise a counter brace 123 acting in opposition to the lever 119 against an interior surface of the bellow 101. As such, for example, for pumping the pump 118, a thumb 106 may be engaged within the notch in opposition against forefingers holding an opposite side of the bellow 101.

Figure 5:
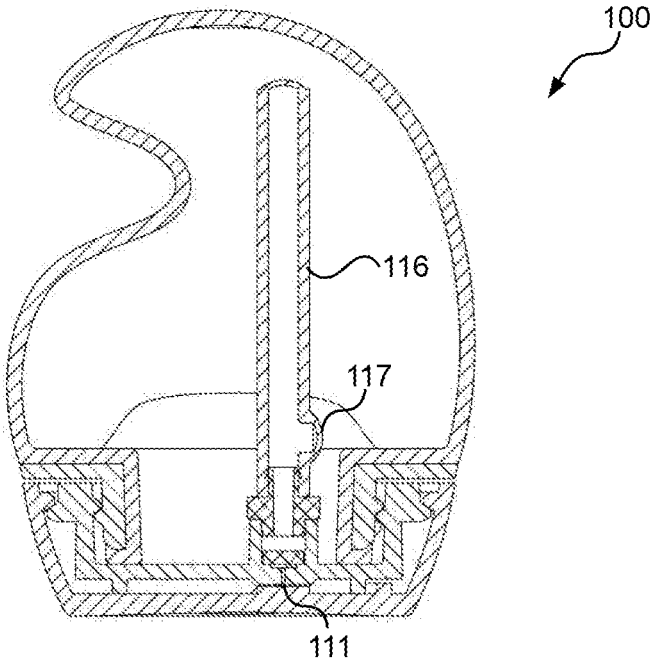
FIG. 5 shows a side elevation cross-sectional view of the device in accordance with an embodiment.

FIG. 5 shows an embodiment of the device 100 devoid of the exterior air outlet 110. In this embodiment, squeezing of the bellow 101 forces pressurised water via the nozzle 111. In this embodiment, the device 100 may comprise the delivery tube 116 which may comprise the liquid inlet 117 towards the base 103 which is thereby submerged within liquid contents allowing liquid to flow into the delivery tube 116 for expulsion via the nozzle 111.

Figure 6:
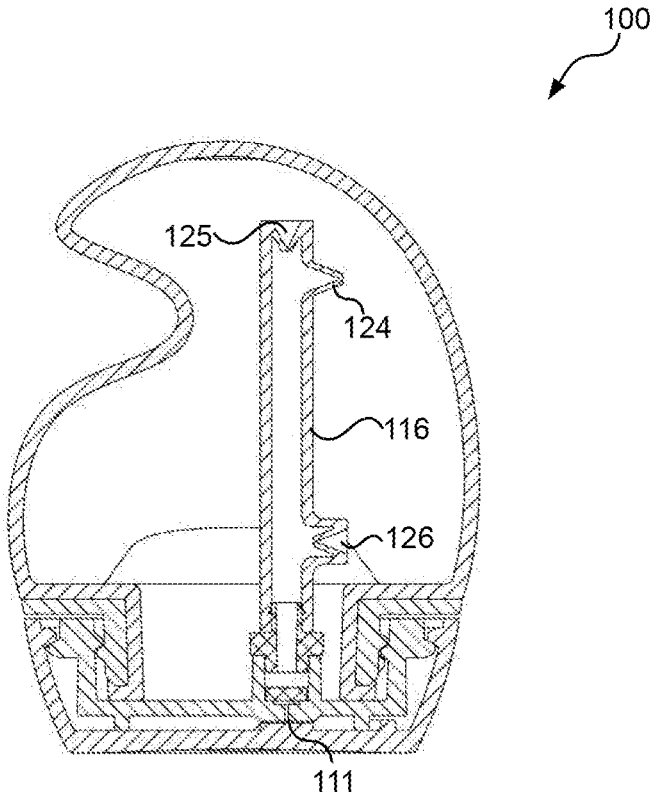
FIG. 6 shows a side elevation cross-sectional view of the device in accordance with an embodiment.

FIG. 6 shows a variation of the embodiment of FIG. 5 wherein the delivery tube 116 comprises a plurality of duckbill valves.

In accordance with this embodiment, the delivery tube 116 comprises a liquid inlet duckbill valve 126 towards the base 106 to allow liquid contents to enter the delivery tube 116 but not escape therefrom.

The delivery tube 116 may comprise an air inlet duckbill valve 125 allowing air entrapped at an upper region of the bellow 101 to into the delivery tube 116.

Furthermore, the delivery tube 116 may comprise an air outlet duckbill valve 124, allowing air to escape into the bellow 101.

Figure 7:
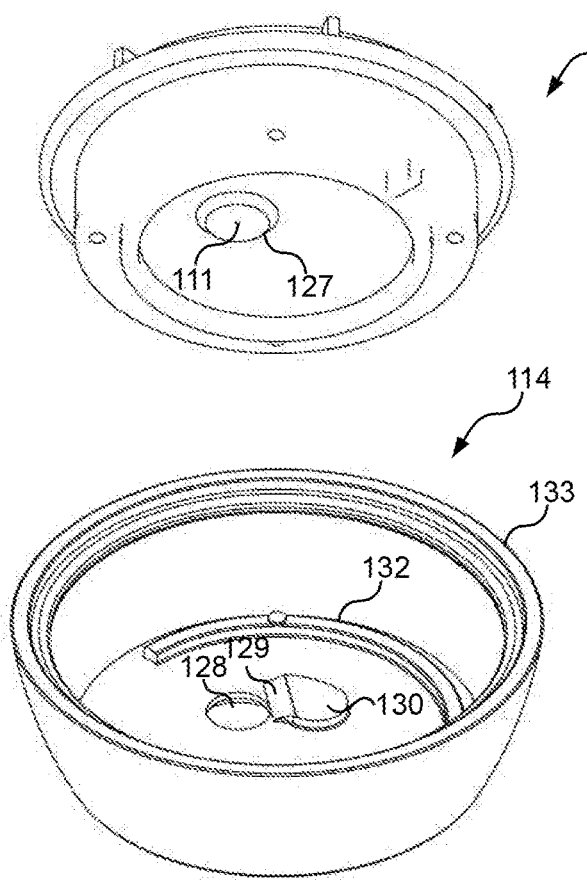
FIG. 7 shows perspective views of an outer section and covering lid of the base in accordance with an embodiment.
Figure 8:
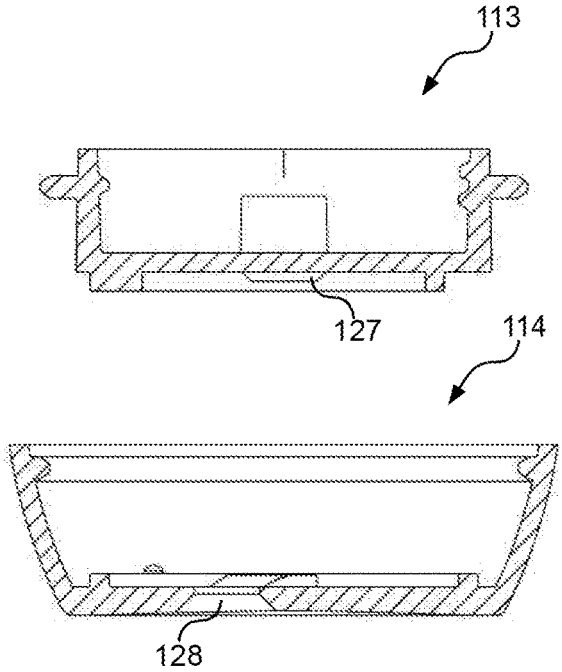
FIG. 8 shows cross-sectional views of the outer section and the covering lid.
Figure 9:
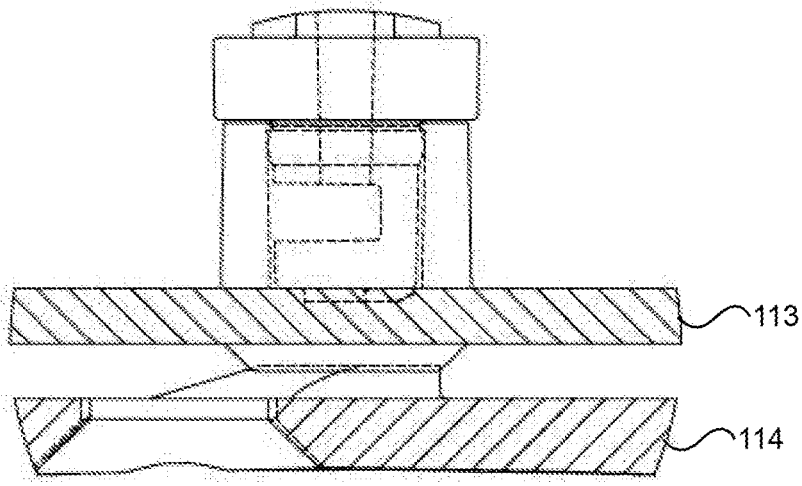
FIG. 9 illustrates the engagement between the outer section and the covering lid.

FIGS. 7-9 illustrates embodiments wherein the lid 114 rotates with respect to the outer section 113 so as to alternatively bring an aperture 108 or stopper 130 in alignment with the nozzle 111.

As is shown in FIG. 7, the undersurface of the outer section 113 may comprise a protrusion 127 defining the nozzle 111 concentrically therethrough.

The lid 114 may comprise a rim 113 engaging the outer section 113 in a rotatable manner. The lid 114 may comprise a rail 132 to control the extent of rotation between the lid 114 and the outer section 113.

As such, at one extent of rotation, the aperture 128 collocates with the protrusion 127, thereby allowing liquid to escape via the nozzle 111.

However, at an opposite extent of rotation, the stopper 113 collocates against the protrusion 127. In the embodiment shown, both the protrusion 127 and the stopper 130 may comprise planar faces for face-to-face sealing as is illustrated in FIG. 9.

The stopper 130 may comprise a lead up a ramp 129 to guide the protrusion 127 to the planar face of the stopper 130.

The foregoing description, for purposes of explanation, used specific nomenclature to provide a thorough understanding of the invention. However, it will be apparent to one skilled in the art that specific details are not required in order to practise the invention. Thus, the foregoing descriptions of specific embodiments of the invention are presented for purposes of illustration and description. They are not intended to be exhaustive or to limit the invention to the precise forms disclosed as obviously many modifications and variations are possible in view of the above teachings. The embodiments were chosen and described in order to best explain the principles of the invention and its practical applications, thereby enabling others skilled in the art to best utilize the invention and various embodiments with various modifications as are suited to the particular use contemplated. It is intended that the following claims and their equivalents define the scope of the invention.

The invention claimed is:

1. A handheld spray device comprising a flexible bellow coupled to a base to thereby retain liquid therein, the bellow comprising a bulbous section adjacent the base, the bellow narrowing away from the base to terminal section opposite the base and having a side notch formed at one side of the bellow between the bulbous section and the terminal section, wherein the base comprises a nozzle therethrough such that when the bellow is squeezed in use, the liquid is forced via the nozzle, and wherein the device comprises an interior liquid inlet adjacent the base and an interior air inlet away from the base, the interior liquid inlet leading to an exterior liquid outlet and the interior air inlet leading to an exterior air outlet and wherein the exterior air outlet directs air towards liquid emanating from the exterior liquid outlet in use.

2. A device as claimed in claim 1, wherein the base comprises an outer section cooperating with an inner section to clamp a rim of the bellow therebetween.

3. A device as claimed in claim 2, wherein the outer section is disengageable from the inner section in use for refilling of the bellow.

4. A device as claimed in claim 1, wherein the bellow comprises silicon.

5. A device as claimed in claim 1, wherein the base is rigid.

6. A device as claimed in claim 5, wherein the base comprises ABS.

7. A device as claimed in claim 1, wherein the device comprises a delivery tube extending perpendicularly from the base defining the interior air inlet at a distal end thereof opposite the base.

8. A device as claimed in claim 7, wherein the delivery tube extends past the notch.

9. A device comprising a flexible bellow coupled to a base to thereby retain liquid therein, the bellow comprising a bulbous section adjacent the base, the bellow narrowing away from the base to terminal section opposite the base and having a side notch formed at one side of the bellow between the bulbous section and the terminal section, wherein the base comprises a nozzle therethrough such that when the bellow is squeezed in use, the liquid is forced via the nozzle and, wherein the device comprises a delivery tube extending perpendicularly from the base defining a liquid air inlet at a proximal end thereof adjacent the base.

10. A device comprising a flexible bellow coupled to a base to thereby retain liquid therein, the bellow comprising a bulbous section adjacent the base, the bellow narrowing away from the base to terminal section opposite the base and having a side notch formed at one side of the bellow between the bulbous section and the terminal section, wherein the base comprises a nozzle therethrough such that when the bellow is squeezed in use, the liquid is forced via the nozzle, and wherein the device further comprises a pump comprising an internal lever acting on an internal fulcrum to depress a plunger within a chamber to force liquid via the outlet.

11. A device as claimed in claim 10, further comprising a brace pressing against an interior surface of the bellow in opposition to the internal lever.

12. A device as claimed in claim 10, wherein the internal lever locates adjacent and interior surface of the bellow at the notch.

13. A device as claimed in claim 9, wherein the delivery tube comprises a duckbill valve orientated in towards the delivery tube at the base.

14. A device as claimed in claim 9, wherein the delivery tube comprises a duckbill valve orientated in towards the delivery tube away from the base.

15. A device as claimed in claim 9, wherein the delivery tube comprises a duckbill valve orientated out from the delivery tube away from the base.

16. A device as claimed in claim 2, further comprising a lid rotatably engaging the outer section and wherein the lid defines an aperture which selectively collocates adjacent the nozzle.

17. A device as claimed in claim 16, wherein the aperture selectively collocates away from the nozzle.

18. A device as claimed in claim 16, wherein the outer section comprises an undersurface protrusion comprising the nozzle therethrough and wherein the lid defines a stopper which selectively locates adjacent the nozzle.

19. A device as claimed in claim 18, wherein the undersurface protrusion comprises a planar face and wherein the stopper defines a planar face which abuts against the planar face of the undersurface protrusion in a flush manner and wherein the stopper comprises a lead up ramp to the inner face thereof.

20. A device as claimed in claim 9, wherein the device comprises an interior liquid inlet adjacent the base and an interior air inlet away from the base, the interior liquid inlet leading to an exterior liquid outlet and the interior air inlet leading to an exterior air outlet and wherein the exterior air outlet directs air towards liquid emanating from the exterior liquid outlet in use.

* * * * *